United States Patent [19]

Anderson

[11] 4,303,174

[45] Dec. 1, 1981

[54] FOOT OPERATED CONTAINER AND COVERING DEVICE

[75] Inventor: Howard A. Anderson, Pittsburgh, Pa.

[73] Assignee: Cities Service Co., Tulsa, Okla.

[21] Appl. No.: 111,425

[22] Filed: Jan. 11, 1980

[51] Int. Cl.[3] ..... B65D 43/26

[52] U.S. Cl. ..... 220/263; 206/515

[58] Field of Search ..... 220/1 T, 260, 262, 263, 220/264; 206/505, 515, 518, 519

[56] References Cited

U.S. PATENT DOCUMENTS 4,150,764 4/1979 Anderson ..... 220/263

*Primary Examiner*—George T. Hall

*Attorney, Agent, or Firm*—Donald L. Traut; Walter M. Benjamin

[57] ABSTRACT

A receptacle device useful for receiving material, comprising a container having an opening, a covering pivotally mounted on the opening, and a substantially U-shaped operating member straddling the container and having at least one end rotatably connected to the covering so that the container can be opened and closed in response to actuating the operating member.

4 Claims, 14 Drawing Figures

FIG. 5
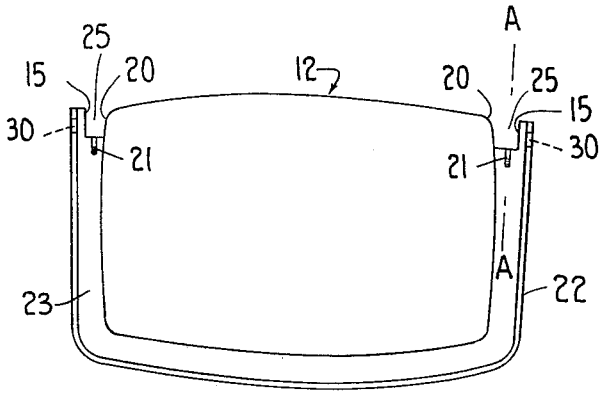
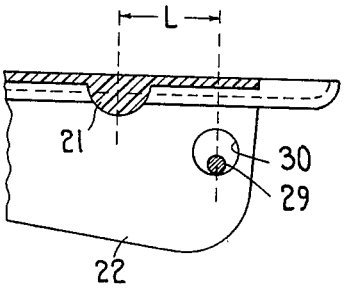
FIG. 6

FOOT OPERATED CONTAINER AND COVERING DEVICE

BACKGROUND OF THE INVENTION

The present invention relates to a receptacle for receiving and containing liquid and solid materials, more particularly this invention relates to a receptacle comprising a container and covering which is pivotally mounted on an opening of the container, and even more particularly this invention relates to a receptacle whose covering can be opened and closed by a substantially U-shaped operating member which straddles the container.

Typical prior art receptical devices of the class within which the present invention falls are disclosed and described in U.S. Pat. Nos. 1,251,984 to J. Losoncy, 1,828,741 to G. R. Lesauvage, 2,419,163 to T. R. Pope, Sr., and 3,450,297 to E. J. Clerk.

Clerk, Lonsoncy and Pope disclose a container, a covering for the open end of the container, a rod and pedal. The closure is pivotally mounted upon the container. The pedal is pivotally connected to the container and also connected to the closure by the rod. In the operation of these devices, the pedal is depressed to pull the rod downward which in turn pulls the connected edge of the closure downward to tilt the closure about its pivotal axis, thereby opening the container.

The most pertinent prior art is Lesauvage which discloses a container, a detachable pivotally mounted closure for the open end of the container, a ball and an operating member. The operating member consists of a single rod attached to the cover, retained and guided by a bail, and formed at its lower end to provide a pedal. The closure is formed with a hinge and a movable butt. The container is fitted with a socket member which is formed to receive the removable butt. To remove the closure from the container, the movable butt is moved upward to disengage it from the socket member.

The prior art device of Lesauvage uses a hinge to keep the closure in register with the container and the operating member is kept in register by a ball. In addition, the method of manufacture of this Lesauvage device is complex and the product does not lend itself to being a stackable item. Moreover, the Lesauvage device is operated from the rear where the closure opens in such a manner to interfere with the operator. Finally, the Lesauvage device is designed to be made out of metal rather than today's more popular injection molded materials.

SUMMARY OF THE INVENTION

In contrast to the above prior art, this present invention contemplates a container having an opening, a covering pivotally mounted on the opening, and a substantially U-shaped operating member straddling the container and having at least one end rotably connected to the covering. Vertical walls of the container define the opening which has at least one bearing surface upon which the covering is pivoted. An element is provided on the covering and rides on the at least one bearing surface when the cover is pivoted. As a result, the operating member can be actuated to cause the covering to pivot on the bearing surface to open and/or close the container.

By having a substantially U-shaped operating member which straddles the container, no other retainer is necessary and the receptacle of the present invention can be operated from the front where the covering opens away from and without interfering with the operator. Yet, the receptacle has only three formable piece parts (such as formed by injection molding) which can be assembled and separated manually. On the other hand, the receptacle can be provided with features such that it does not easily come apart when the covering is in the open position. However, when the covering of the receptacle is near the closed position it can be lifted and removed from the container with relative ease so that the contents of the container can be removed and especially for placing and removing a liner from the container.

BRIEF DESCRIPTION OF THE DRAWING

Other features and advantages of the present invention will become more apparent from an examination of the following specification when read in conjunction with the appended drawings, in which:

FIG. 5 is a bottom view of the closure of FIG. 1 and shows arcuate tabs operable to rotate the covering on the container and shows a channel which is operable to keep the covering in register with the container;

FIG. 6 is an expanded fragmentary section of the line A—A in FIG. 5, showing the arcuate tabs on the covering;

DETAILED DESCRIPTION OF THE INVENTION

Figure 1:
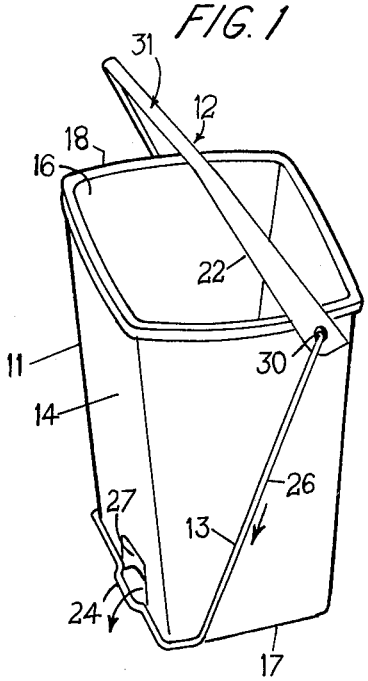
FIG. 1 is a perspective view showning the receptacle according to an embodiment of the invention where the covering is pivoted on depressions in a beaded rim around the opening of the container, which depressions defines a bearing surface, the covering being shown in the raised or open position and the operating member having been actuated.

Referring now in detail to the drawing of FIG. 1, the receptacle, indicated generally by reference 11 includes an open container 14, covering indicated generally by reference 12 and operating member indicated generally by reference 13.

The container 14 includes an open end 16 and a bottom 17. The cross sectional of the open end 16 is larger than the bottom 17 thus defining a vertically tapered container which can be stacked inside a like container to facilitate telescoping a plurality of containers for storage, shipments or display.

Figure 2:
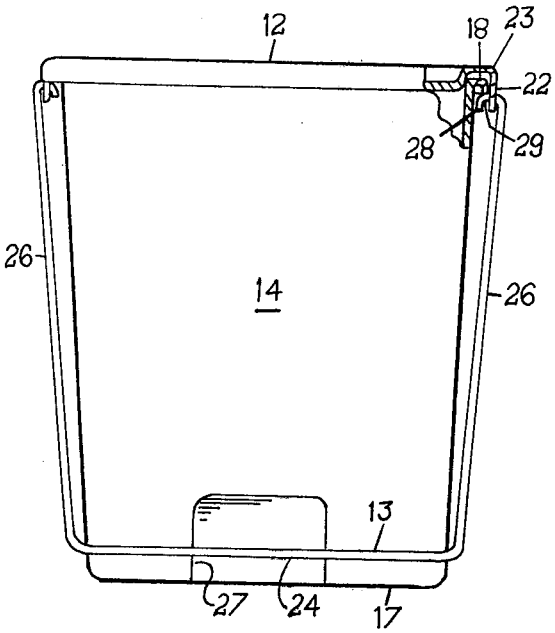
FIG. 2 is a front view of the receptacle device shown in FIG. 1 and the covering is in the lowered or closed position while the operating member is not being actuated and a fragmentary view of one cover of the container and covering showing a beaded rim of the container and a bridge in return which acts as a stop for the operating member.
Figure 3:
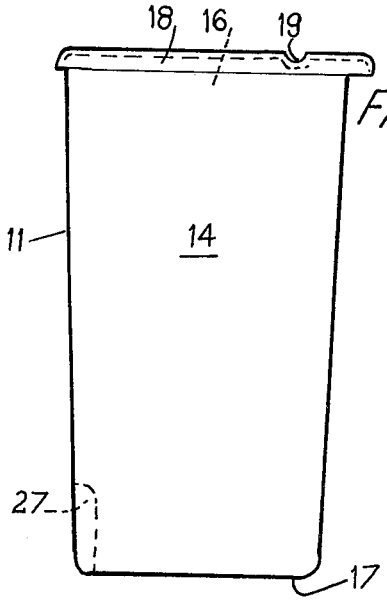
FIG. 3 is a side view of the container of FIG. 1 and shows depressions defining a bearing surface in the beaded rim.
Figure 4:
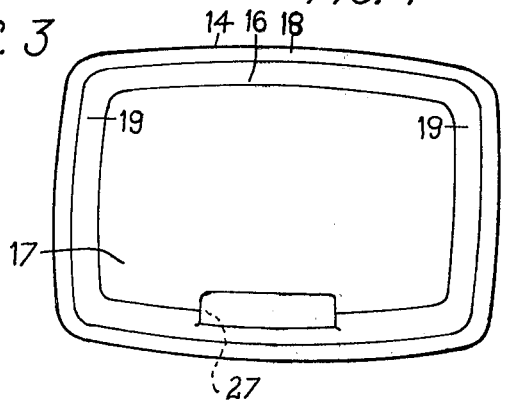
FIG. 4 is a top view of FIG. 1 and shows the depressions in the beaded rim.

Referring to FIGS. 1, 2, 3, and 4, the open end 16 of the container 14, has a beaded rim 18 defining a circular shape in cross-section as is most apparent in the fragmentary section of FIG. 2. The beaded rim 18 is interrupted by a pair of opposed depressions defining bearings 19-19 which cooperate with the covering 12 in a manner to be described hereinafter.

Referring to FIGS. 3, 4, 5, and 6, the covering 12 is adapted to cover the open end 16 of the container 14. Additionally, a margin 22 of the closure is formed with arcuate tabs 21-21 which mate with and are rotable within the bearings 19-19. The margin 22 is also formed with a peripheral channel 23 which receives the beaded rim 18 of the container 14 when the covering 12 is in the closed position as apparent in FIG. 2. The channel 23 cooperates with the beaded rim 18 when the covering is in the closed position to maintain arcuate tabs 21-21 in register with the bearings 19-19.

The channel 23 is formed with slots 25-25 which are adjacent to arcuate tabs 21-21 and have side walls 15-15 and 20-20 operable to straddle the beaded rim 18 of the container 14 to maintain the arcuate tabs 21-21 in register with the bearings 19-19 during the opening and closing operation of covering 12.

The margin 22 of the covering 12 is formed with a pair of opposed apertures 30-30 for receiving arms 26-26 of the operating member 13. The arms 26-26 terminate in return bins 28-28 which are a space from arm 26-26 by bridges 29-29 to effect a separable, rotable connection between the operating arms 26-26 and the covering 12 (see FIG. 2).

Alternatively the margin 22 of the closure 12 in the region of the appatures 30-30 is formed with a pair of inwardly projecting bridges (not shown) in sufficient length to register with and bear against the beaded rim 18 of the container 14 when the covering 12 is in the open position.

Referring in detail to FIGS. 1, 2, and 6, the operating member 13 is of a substantially U-shaped configuration generally straddling the container 14, and includes a treadle 24 centrally disposed relatively to the arms 26-26 and opposes a recess 27 which provides a space for operation of the treadle.

The container and covering can be made of the same or different materials. For example, both can be made from plastic or metal, or one can be of plastic and the other being metal. The operating member of the present invention can be made of plastic or metal, preferably the member is formed of metal and the container and covering are preferably formed from injection molded plastic.

It can be noted that the appatures 30-30, formed in the margin 22, must be so disposed relative to the bearings 19-19 and cooperating arcuate tabs 21-21 to develop a lever arm, such as indicated by the letter L in FIG. 6, effective to create sufficient mechanical advantage when the treadle 24 is actuated in the direction shown by the arrow of FIG. 1 to raise the covering to the open position.

The receptical device of the present invention operates in the following fashion: with the device in the closed position as shown in FIG. 2, actuation of treadle 24 is effective to raise the covering 12 to the open position as shown in FIG. 1. The release of the treadle permits covering 12 to return to the closed position in response to gravity.

It can be noted that when the closure 12 is in the open position, it is possible to grasp the covering manually along with the margin indicated by the reference numeral 31 permitting one to lift the complete receptacle without separating the closure 12 from the container 14 and that bridges 29-29 are lifted into contact with beaded rim 18 precluding separation of the covering and the container. Consequently, this structure and function permits the receptacle to be transported as a unit conveniently.

It is therefore obvious that the three basic elements, mainly covering 12, container 14 and operating member 14 are manually separable and readily assembled for storage, shipping, or display.

It is therefore anticipated that a wide variety of modifications and design changes can be developed without departing from the spirit of the scope of the present invention.

Figure 7:
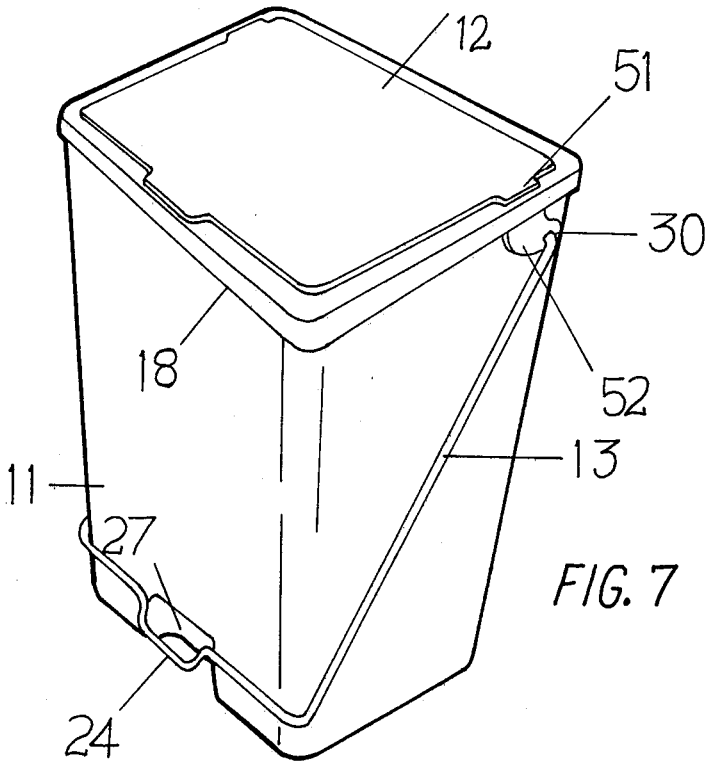
FIG. 7 is a prospective view showing a receptacle according to a further embodiment of the invention, the covering having a lever which is inserted through the rim of the container.

For example, FIG. 7 shows a different style covering 31 which fits inside the opening of the container 11 and ears 52 are formed thereon to be inserted down through a slot 51 in the beaded rim 18. Actuating member 13 is rotably mounted in aperture 30. Container 11 is formed with a recess 27 to provide space for operation of treadle 24 of actuating member 13. In this embodiment the bearing surface would be located adjacent to the slot in the beaded rim and under the covering (not shown). An element is formed on the covering to mate with the bearing surface such that when the operating member is actuated, the covering pivots to an open position while the element rides in the bearing surface.

Figure 8:
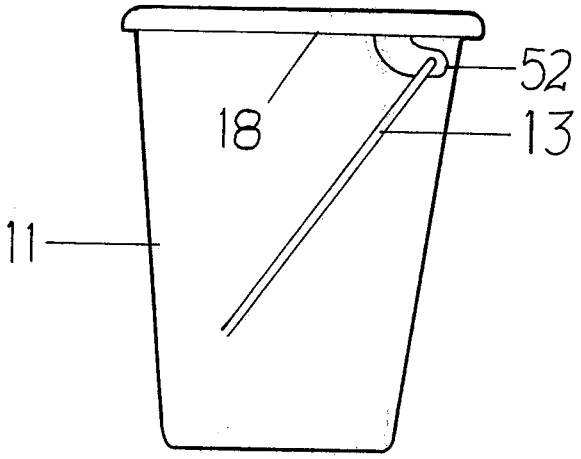
FIG. 8 is a side view of FIG. 7.

FIG. 8 is a side view of the embodiment depicted by FIG. 7 and shows actuating member 13, container 11, beaded rim 10, and ear 52.

Figures 9, 10, 11:
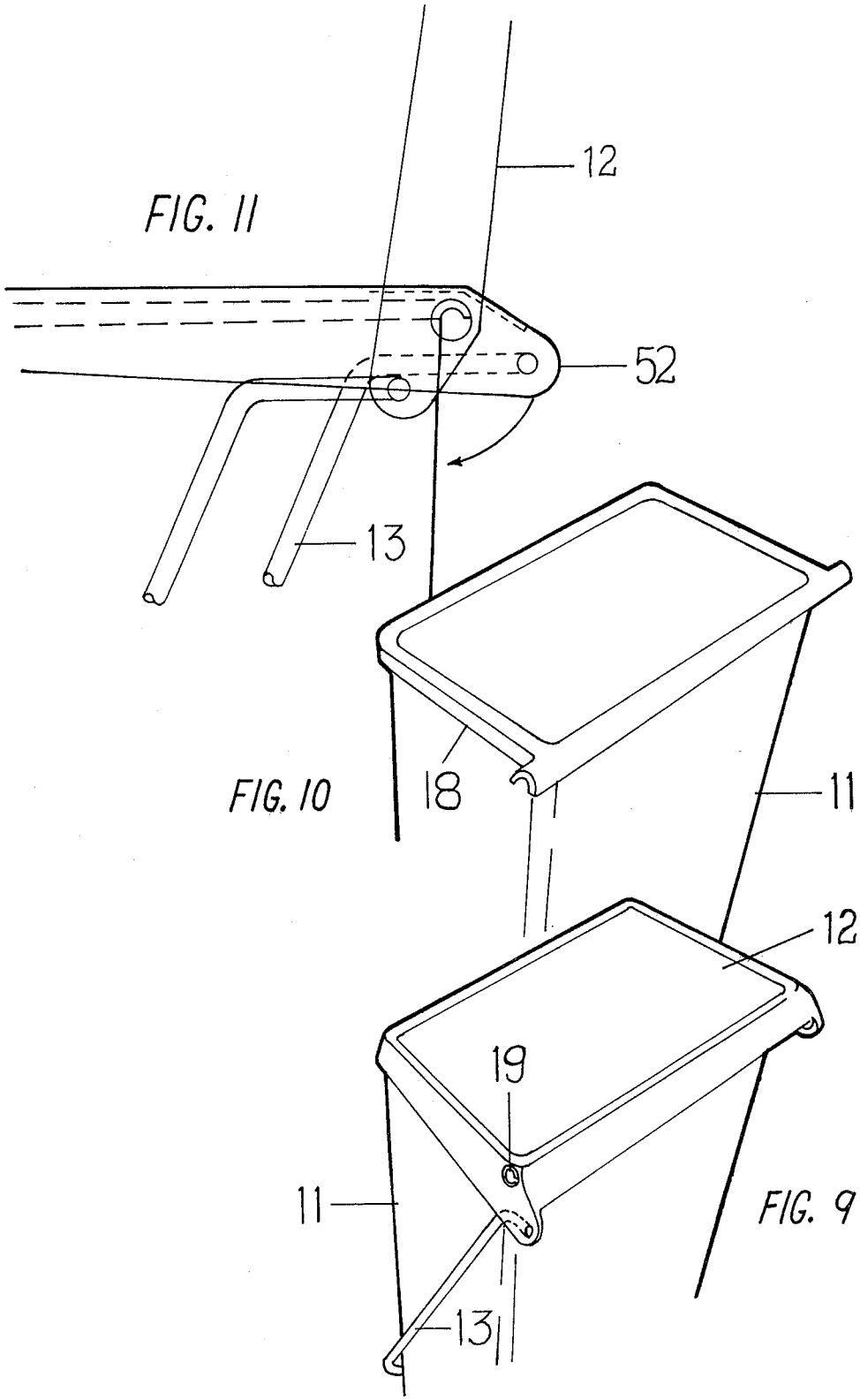
FIG. 9 is an even further embodiment of the receptacle of the invention where the bearing surface is a molded pivot along one edge of the opening of the container.
FIG. 10 is a detail of the molded pivot of FIG. 9.
FIG. 11 is a detail of an opened covering of FIG. 9.

FIG. 9 shows yet another modification or embodiment of the present invention. In this embodiment the bearing surface extends along an entire edge of the opening of the container between molded pivots 19. This allows the covering 31 to be open away from the opening such that containers can be inserted inside each other for the purpose of stacking without removing the covering 31 from the container 11.

FIG. 10 shows both molded pivots 19 upon which the covering 31 is mounted as shown in FIG. 11. These pivots 19 are an integral part of rim 18.

FIG. 11 shows a detail of the actuating member 13, covering 31 and projecting ears 52 of the embodiment of FIG. 9. The actuating member 13 is rotably mounted on ear 52 and the covering 31 is pivotally mounted on the rim between molded pivots 19.

Figure 13:
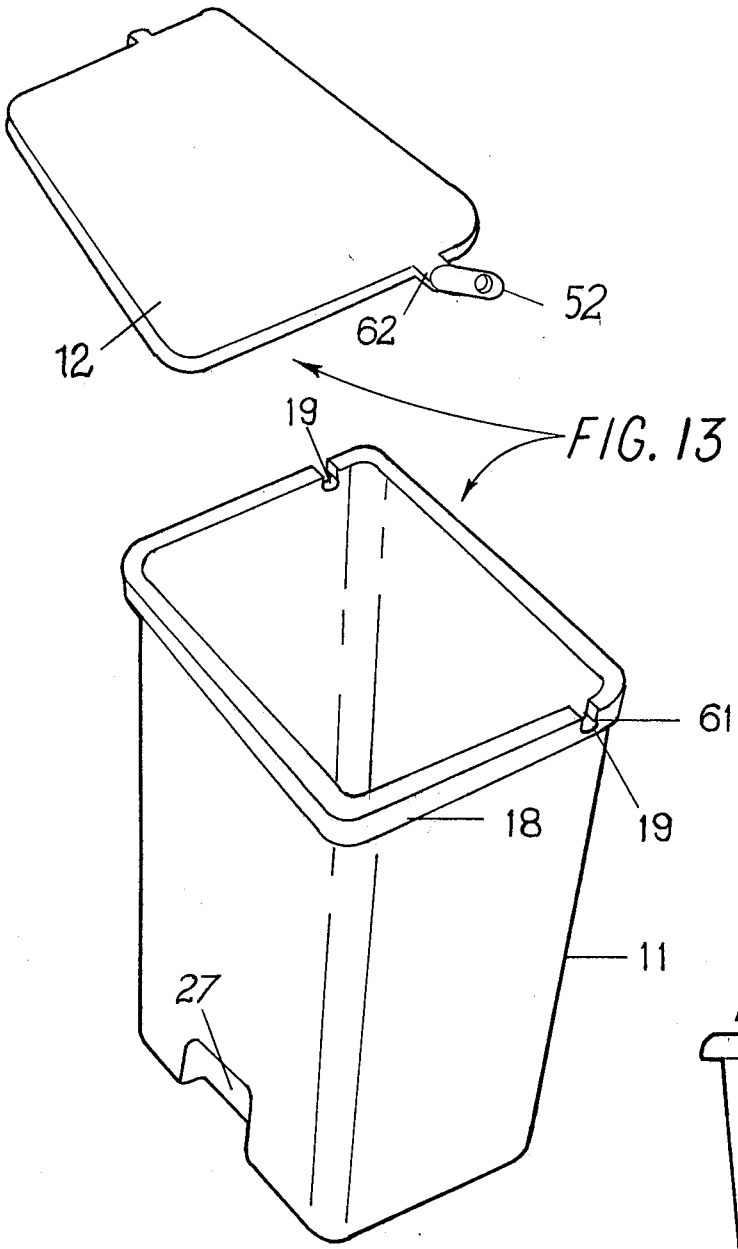
FIG. 13 is a view of the covering removed from the container of FIG. 12.
Figure 12:
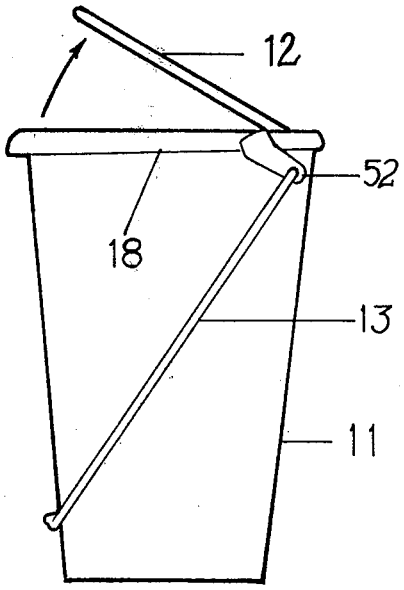
FIG. 12 is an even further embodiment of the receptacle of the present invention where the covering is mounted over the opening of the container by a snap-lock arrangement.

FIGS. 12 and 13 shows yet another embodiment where the covering 31 is attached to the container 11 by a snap-lock 61 which acts along with the bearing surface 19 upon which the covering bearing 62 is pivoted. This arrangement allows for the covering 31 to be of a size which can be placed inside of the opening of the container, yet the covering 31 is firmly attached to the container 11. When the covering 31 is in the open position, it can be seen that the space between the ear 52 and the outer edge of the rear of the covering 31 will engage the beaded rim 18 so that the covering will be firmly registered with the container 11. Recess 27 is also shown.

Figure 14:
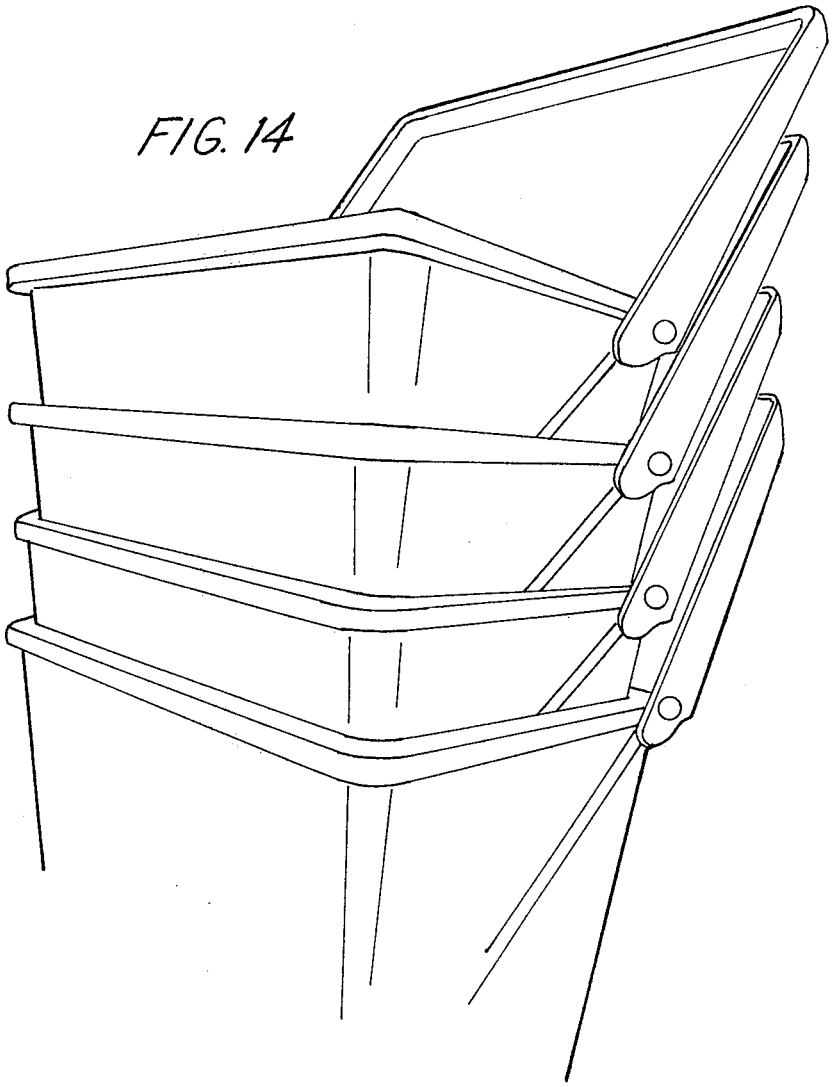
FIG. 14 shows several receptacles of the embodiment depicted by FIG. 8 in a stacked arrangement.

As an aid to show the utility of various embodiments of the present invention, FIG. 14 shows the embodiment depicted in FIG. 9 in a stacked arrangement. The stacking of the receptacle in this manner facilitates storage, shipment and display of the receptacle. This is important from the standpoint of economizing on available space.

Hence, it is apparent that many modifications are possible.

I claim:

1. A three element receptacle for receiving material comprising:

(a) a container having an opening;

(b) a covering pivotally mounted on the opening;

(c) a substantially U-shaped operating member straddling the container and having both ends rotably connected to the covering;

wherein the walls of the container which define the opening has at least one bearing surface upon which the cover is pivoted; wherein the covering has an element which rides on the at least one bearing surface when the cover is pivoted wherein the operating member can be actuated to cause the covering to pivot on the bearing surface to open and/or close te container; and wherein the covering has ears to which the operating member is attached and the ears are mounted through a rim of the container.

2. The receptacle of claim 1 wherein the bearing surface is a snap-lock opening into which the covering can be fastened.

3. A three element receptable for receiving material comprising:

(a) a container having an opening:

(b) a covering pivotally mounted on the opening;

(c) a substantially U-shaped operating member straddling the container and having at least one end rotably connected to the covering;

wherein the walls of the container which define the opening terminates into a beaded rim which is interrupted by at least one bearing surface; wherein the covering has an element which rides on the at least one bearing surface when the cover is pivoted; wherein the covering is formed to define an open space to mate with the beaded rim to keep the covering in register when the covering is in the open position; wherein the operating member can be actuated to cause the covering to pivot on the bearing surface to open and/or close the container; and wherein the covering has ears to which the operating member is attached and wherein the ears are mounted through the beaded rim.

4. The receptable of claim 3, wherein the bearing surface is a snap-lock opening into which the covering can be fastened.

* * * * *